United States Patent [19]

Clement

[11] Patent Number: 4,601,250

[45] Date of Patent: Jul. 22, 1986

[54] ROTARY LOOP TAKER FOR LOCK-STITCH SEWING MACHINE

[75] Inventor: James W. Clement, Chicago, Ill.

[73] Assignee: Bakron Corp., Lakewood, Colo.

[21] Appl. No.: 604,327

[22] Filed: Apr. 26, 1984

[51] Int. Cl.[4] ..... D05B 57/08

[52] U.S. Cl. ..... 112/184; 112/230

[58] Field of Search ..... 112/181, 184, 228, 229, 112/230, 231

[56] References Cited

U.S. PATENT DOCUMENTS

| | | | |
|---|---|---|---|
| 780,028 | 1/1905 | Finkle | 112/184 |
| 1,431,380 | 10/1922 | Dickson | 112/228 |
| 2,019,284 | 10/1935 | Wesson | 112/228 |
| 2,202,586 | 5/1940 | Karle | 112/228 X |
| 3,139,050 | 6/1964 | Grabowski | 112/228 X |
| 3,465,700 | 9/1969 | Kuhar | 112/228 |
| 4,493,278 | 1/1985 | Badillo | 112/184 |

FOREIGN PATENT DOCUMENTS

| | | | |
|---|---|---|---|
| 62209 | 5/1892 | Fed. Rep. of Germany | 112/228 |
| 933601 | 9/1905 | Fed. Rep. of Germany | 112/230 |

*Primary Examiner*—Wm. Carter Reynolds

*Attorney, Agent, or Firm*—Clement and Ryan

[57] ABSTRACT

A rotary loop taker which includes a replaceable loop seizing point mounted on a substantially annular frame, for use in a lock-stitch sewing machine. The loop seizing point has a supporting lug that extends downwardly from immediately behind the base portion of the tapered forward end of the loop seizing point. The supporting lug forms a smoothly curved junction with the base portion of the tapered forward end of the loop seizing point. The rearwardmost position on the smoothly curved junction to which said needle thread loop is pulled by the rotating loop taker lies a first distance from the nearest point on the crack formed by the supporting lug and the wall of the annular frame against which the lug abuts that is sufficient to produce a second distance measured normal to the taut needle thread loop that will avoid snagging the needle thread in the crack just referred to during operation of the sewing machine. The supporting lug has a continuation portion below the smoothly curved junction that is smoothly shaped to avoid letting any needle thread loop that may move downward as it falls slack from the tapered forward end base portion during normal operation of the sewing machine pass either partly or entirely beneath the lug.

18 Claims, 12 Drawing Figures

FIG. 5
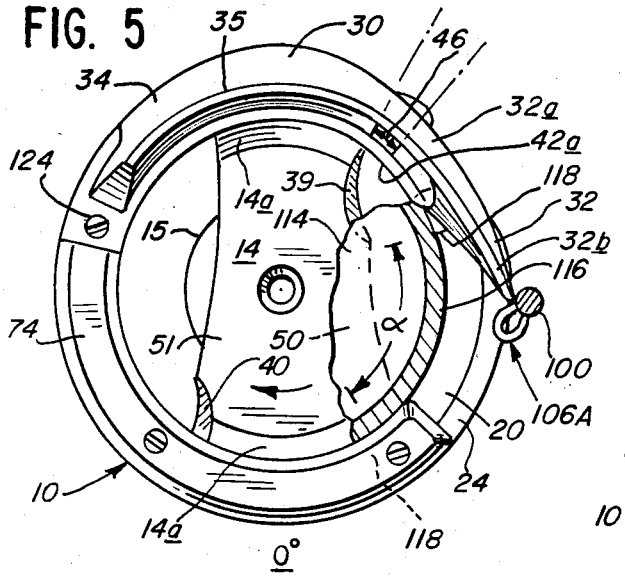
FIG. 6
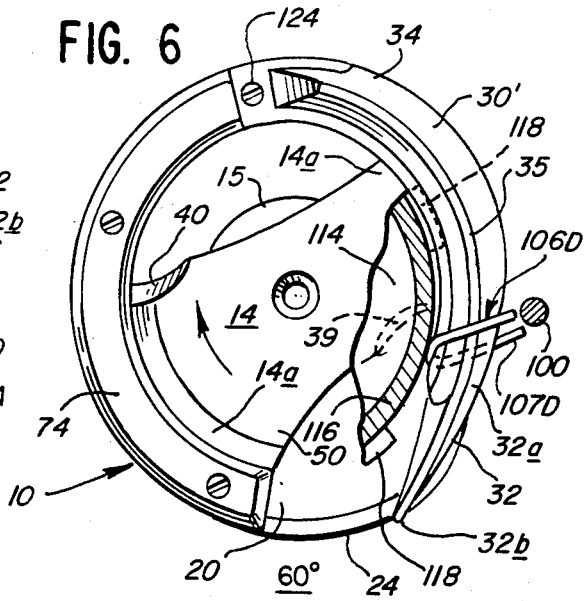
FIG. 7
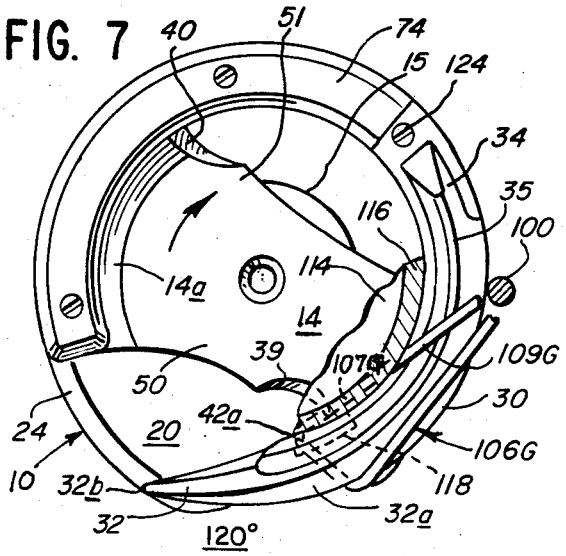
FIG. 8
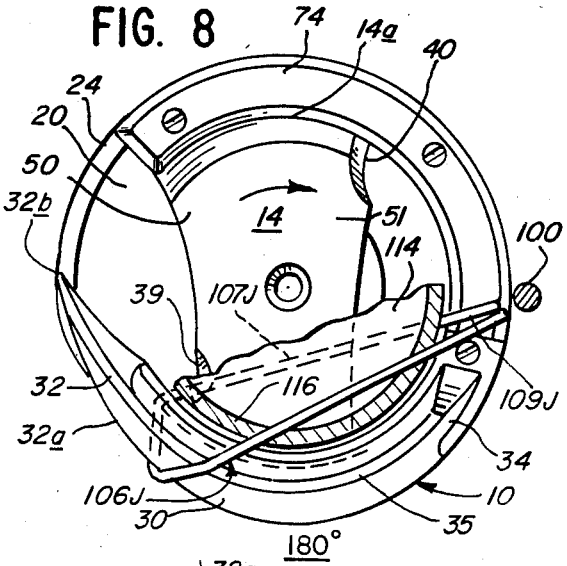
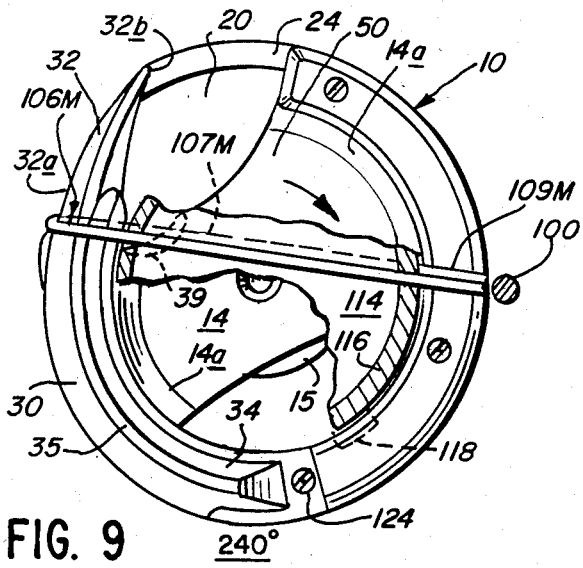
FIG. 9
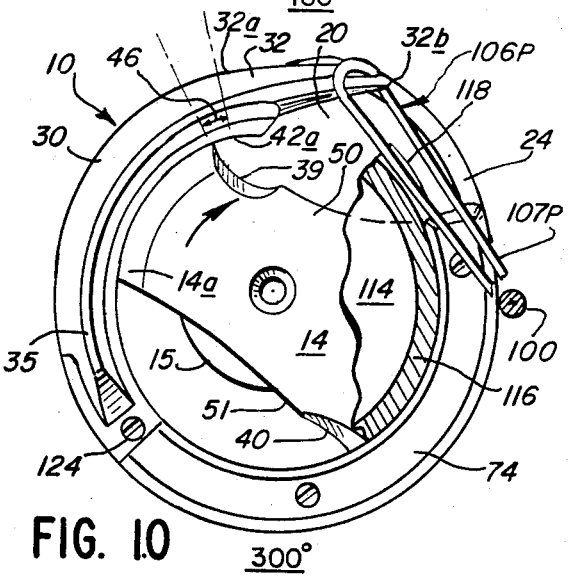
FIG. 10

FIG. 11
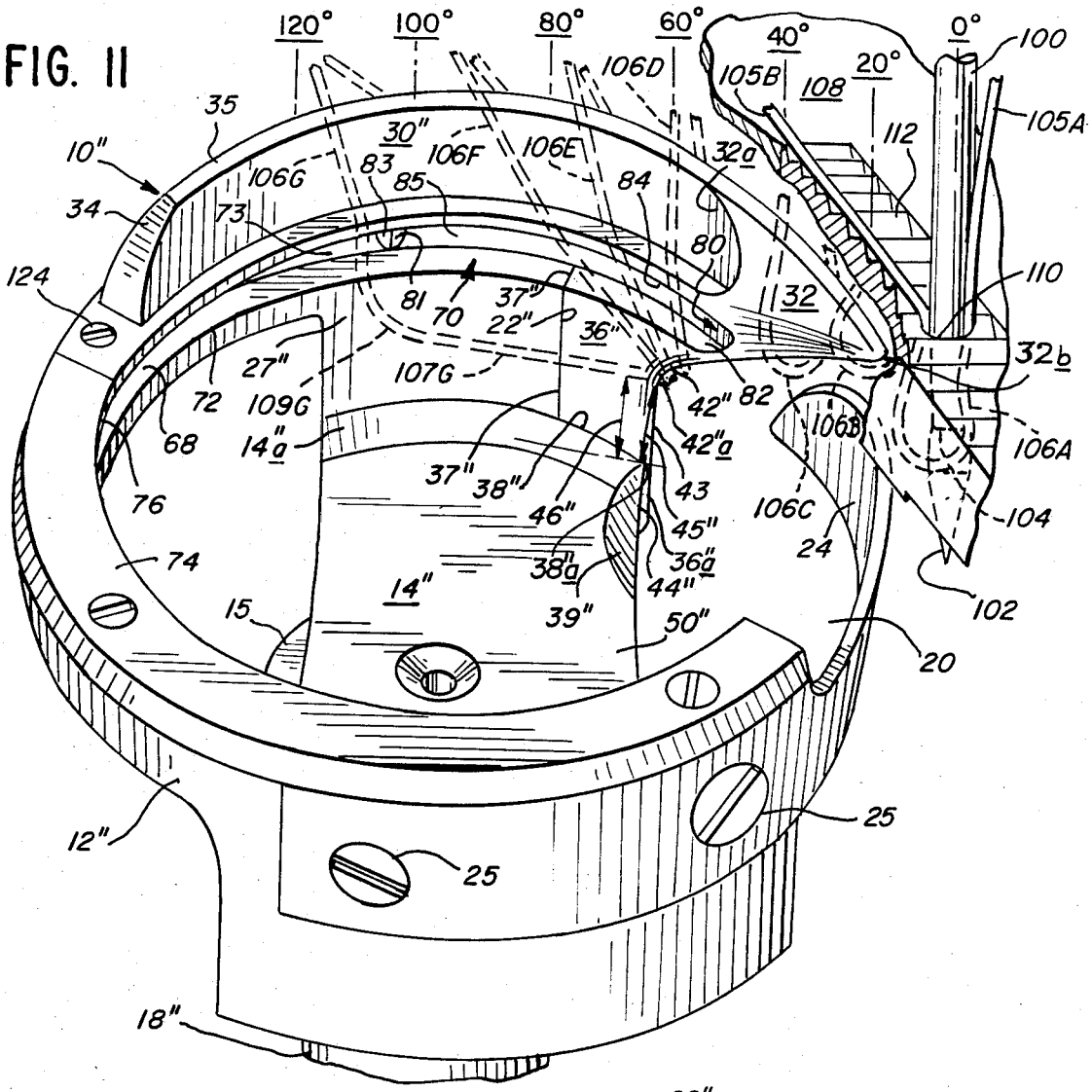
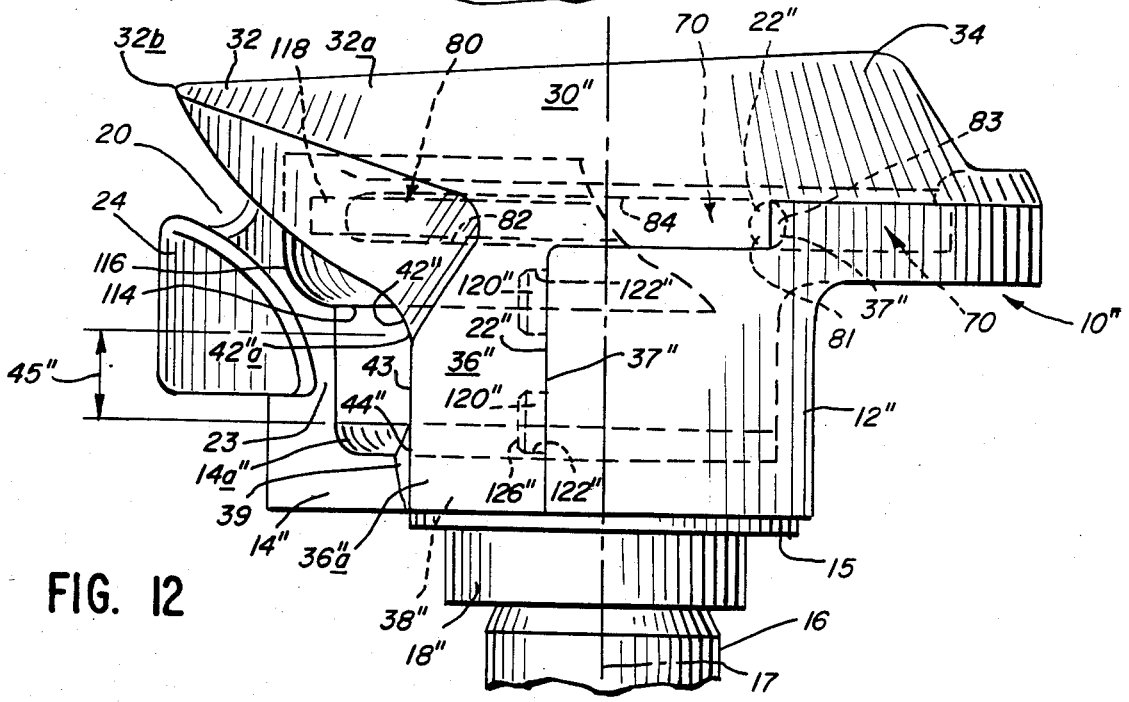
FIG. 12

ROTARY LOOP TAKER FOR LOCK-STITCH SEWING MACHINE

FIELD OF INVENTION

This invention relates to a rotary loop taker for use in a lock-stitch sewing machine in which the take-up device is located above the bobbin case, and in particular to such a loop taker that has a replaceable hook or loop seizing point.

BACKGROUND OF INVENTION

A rotary loop taker is a device that must be incorporated into all lock-stitch sewing machines. Perhaps 70 to 80 percent or more of all industrial sewing machines are of the lock-stitch type, and therefore utilize a rotary loop taker. Lock-stitch sewing machines of the type described are especially useful for sewing canvas, leather, or other heavy materials.

The conventional loop taker is precision machined of fine steel to accurate proportions and balance throughout its extent from its weighted hub to its fragile hook or "loop seizing point." It is a costly item, and a short-lived item under the heavy wear and tear that accompanies the use of a typical industrial sewing machine. Conventional loop takers have a life of only three to six months, depending on the many variables involved.

Because no one prior to the inventor in certain copending, commonly assigned applications (of which the earliest filed is Badillo application Ser. No. 292,036, filed Aug. 11, 1981 and now abandoned) has understood how to construct a rotary loop taker with a detachable loop seizing point that is a satisfactory device, conventional loop takers are currently constructed—as they have been for more than 60 years—with the loop seizing point formed integrally with a substantially circular frame member and with a crosswise extending frame support member as well. This of course requires that when either the loop seizing point or the initial portion of the bobbin case raceway that is an important part of the rotary loop taker has become damaged, the entire loop taker must be discarded.

The most vulnerable part of the fragile loop seizing point of a rotary loop taker is the tip. The tip can, for example, be chipped by the needle of the sewing machine, or burred by the friction that is created by the high speed revolutions of the loop taker as it picks up the thread off the needle. Since a faulty hook or loop seizing point tends to skip stitches, it must be repaired or replaced whenever its fragile loop seizing point accidentally breaks or becomes too dull through normal wear.

With the rotary loop taker of the usual type, most factories simply discard the entire device when the loop seizing point (which as pointed out is conventionally an integrally formed part of the loop taker) becomes chipped or otherwise rendered unusable. Others send the rotary loop taker to a facility that reprocesses the tip of the loop seizing point at great time loss. Either expedient is very costly.

The advantages that would be provided by a rotary loop taker with a detachable loop seizing point that could be readily removed and replaced with a new point were recognized at least six decades ago. Dickson Pat. No. 1,431,380, issued Oct. 10, 1922 on an application filed Jan. 25, 1921, attempted to provide such a loop taker. However, for several reasons the loop taker disclosed in that patent was unsatisfactory, and so far as is known was never practiced commercially.

Shortly before the Dickson patent just mentioned was issued, another patent was granted (Smith No. 1,415,268, issued May 9, 1922) that contained a good discussion of the problem in a revolving hook machine of replacing a damaged loop seizing point that is integrally formed with the rest of the rotary loop taker (page 3, lines 76–119). That patent attempted to solve the problem referred to by providing a vertically laminated hook in which the tip is secured to the rest of the hook by a set of screws and can be removed and replaced as required. (The term "vertically laminated hook" is used in this specification to refer to a loop seizing point that is laminated in layers that are parallel to the shaft of the rotary loop taker.) The device disclosed in the Smith patent was thus a detachable loop seizing point of an entirely different type from applicant's detachable hook.

Loop seizing points of vertically laminated construction unavoidably present cracks in which the needle thread loop can get caught, either in the operation of the sewing machine in a forward direction or (as is more or less common for certain purposes) in the reverse direction. Such laminated devices also present other cracks in which lint and dirt can be trapped. In addition, a vertically laminated loop seizing point is inherently weaker, and usually possesses less total mass and thus provides a less solid construction, than an integrally formed loop seizing point. Finally, some specialized hooks are so thin in the radial direction with respect to the annular supporting frame that vertical lamination is not feasible.

Despite these disadvantages, until the rotary loop takers covered by the above mentioned commonly assigned applications were invented, the approach of vertical lamination was followed, ever since the Dickson patent was issued, in all but two industrial detachable loop seizing point patents of which applicant is aware. Examples of detachable loop seizing points that are fabricated in vertically laminated form are the devices that are disclosed in the patents to Corrall et al. U.S. Pat. No. 2,002,172 issued May 21, 1935, Joseph U.S. Pat. No. 2,495,637 issued Jan. 24, 1950, Corey U.S. Pat. No. 3,140,681 issued July 14, 1964, Corey U.S. Pat. No. 3,223,060 issued Dec. 14, 1965, and Kuhar U.S. Pat. No. 3,465,700 issued Sept. 9, 1969.

The only prior art patents issued after the Dickson patent for rotary loop takers with detachable loop seizing points for use in an industrial sewing machine that do not follow the lamination approach that are known to applicant are Grabowski U.S. Pat. No. 3,139,050, issued June 30, 1964 and Thiermann German Pat. No. 933,601, issued Sept. 29, 1955.

The detachable loop seizing point disclosed in the former patent is designed to be used with an industrial sewing machine having a take-up device (ordinarily of the roller type) that is located below the bobbin case of the machine, and the complicated and expensive construction of that loop seizing point is for several reasons entirely unsuited for use with a sewing machine in which the take-up device is located above the bobbin case.

As explained below, the Thiermann rotary loop taker is unsatisfactory because, among other things, it lacks the feature of the present invention that avoids the danger of having slack needle thread loops falling partly or entirely under the bottom of the downwardly extending supporting lug of the loop seizing point, where they can be snagged and broken or cause the serious condition known as "thread lock."

SUMMARY OF THE INVENTION

The rotary loop taker of this invention, which is adapted for rotation about a generally cylindrical bobbin case that carries a radially extending rib for engaging the loop taker as the latter rotates about the bobbin case, which bobbin case is maintained in a substantially fixed position in a lock-stitch sewing machine below the take-up device of the machine, comprises a frame of substantially annular construction, means for rotatably supporting the frame, a detachable loop seizing point mounted on the frame, and means for detachably securing the loop seizing point to the frame. As the means for supporting the annular frame rotates during operation of the sewing machine, it rotates the frame about the fixed bobbin case in a predetermined plane, which plane may be horizontal, vertical or other, so long as the take-up device is above the bobbin case.

The substantially annular frame has a cut-away portion along one segment of its circumference, which portion is defined by opposing end walls of the frame facing upon the cut-away portion. It is preferred that the frame be supported by a frame support member extending crosswise thereof, with one edge portion of that member facing the cut-away portion of the frame, and that that edge portion and the one of the frame end walls facing upon the cut-away portion that is at the trailing end of the frame cut-away portion during rotation of the frame define a lug-receiving notch that has a first wall that is generally concentric with the outer circumference of the frame and at its outer end is at least as far from the center of said annular frame as is the inner wall of said frame, and a second wall generally radially positioned with respect to the frame. The lug-receiving notch extends (1) inwardly from the outer circumference of the frame, (2) along the frame in an angular direction opposite to the direction of forward rotation of the frame, and (3) axially entirely through said crosswise extending support member. In this embodiment, a rotatable shaft for the annular frame is attached to the frame support member, extending at generally right angles thereto, for rotating the frame about the bobbin case in a predetermined plane during operation of the sewing machine.

Whether or not a lug-receiving notch is present, the inwardly facing surface of the hereinafter described downwardly extending supporting lug of the detachable loop seizing point, including any member integrally formed with the lug, is located at its forward end at least as far from the center of the annular frame as the inner wall of the frame.

The detachable loop seizing point has generally the same curvature as the substantially annular frame. It has a supporting lug that extends downward into the cut-away portion of the frame; in particular, when the lug-receiving notch is present as described above, the supporting lug extends downward into that notch in nesting relationship with the notch. Specifically, the supporting lug has a rearwardly facing surface that abuts, at all times and throughout substantially the entire height of the lug, substantially the entire forwardly facing frame end wall that is at the trailing end of the cut-away portion during rotation of the shaft, and in addition perferably has an inwardly facing surface that abuts at all times substantially the entire outwardly facing surface of the first wall of the preferred notch. This dual abutting relationship between the mass of the downwardly extending lug and lug-receiving notch within which it is nested provides solid and reliable support for the detachable loop seizing point.

The detachable loop seizing point has a single forward end that extends forwardly of the downwardly extending lug into the cut-away portion of the frame. A rear portion of the loop seizing point extends rearwardly of the lug along the annular frame, preferably at least about as far rearwardly of the downwardly extending lug as the reduced forward portion extends forward of the lug.

The detachable loop seizing point is integrally formed from one end to its other end. Its forward end is continuously tapered, smoothly shaped, and integrally formed. This tapered forward end has its largest transverse dimensions in a base portion and tapers to its smallest transverse dimensions at its free end.

The supporting lug mentioned above extends directly downward into the cut-away portion of the substantially annular frame from immediately behind the base portion of the tapered forward end of the detachable loop seizing point, and forms a smoothly curved junction, free of any seams or joints, with the base portion of the tapered forward end of the loop seizing point guiding the loop of needle thread that is taken up by the loop seizing point, as the loop moves from the tip of the forward end to the base portion of the forward end and back again.

The rearwardmost position on the smoothly curved junction to which the needle thread loop is pulled by the rotating loop taker lies a first predetermined distance, measured along the downwardly extending supporting lug, from the nearest point on the crack that is formed (1)by the supporting lug and the substantially annular frame against which the lug abuts, and (2) in particular, when the preferred lug-receiving notch is present, by the supporting lug and the first wall of the lug-receiving notch against which it abuts. This first distance is sufficient to produce a second distance, measured normal to the taut needle thread loop, between the thread loop and the crack just referred to that will avoid snagging of the thread in the crack when it is pulled taut against the above mentioned smoothly curved junction during operation of the sewing machine. The first mentioned distance that is measured along the supporting lug may be measured in any direction, whether horizontally in a plane normal to the axis of the substantially annular frame, vertically in a direction substantially parallel to that axis, or diagonally. Although the first mentioned distance is described as the distance from the nearest point on the crack between the supporting lug and the annular frame against which it abuts to the rearwardmost position of the needle thread loop, it may of course also be measured in the opposite direction, from that rearwardmost position to the crack in question. In other words, the distance may be measured in either circumferential direction, it may be measured vertically either up or down, or it may be measured diagonally either up or down.

As will be seen from FIGS. 4 and 11, the direction in which the distance is measured is determined by the location of the position on the crack between the supporting lug and the annular frame against which it abuts that is nearest to the rearwardmost position assumed by the needle thread loop as it moves back on the smoothly curved junction and then forward again.

The substantially annular frame of the rotary loop taker of this invention has a predetermined inner diameter, and the above mentioned first predetermined distance measured in any direction (as just described) along the downwardly extending supporting lug between (1) the needle thread loop rearwardmost position on the smoothly curved junction along which the loop slides and (2) the nearest point on the crack between the supporting lug and the substantially annular frame (for example) the first wall of the lug-receiving notch, against which the lug abuts may be defined in relation to this inner diameter. The distance in question is advantageously at least about 1/27 of the predetermined inner diameter of the annular frame. Improved results are obtained if this distance is at least about 1/13 of the predetermined inner diameter of the substantially annular frame, and it is preferred that the distance be at least about 1/9 of that diameter.

In a preferred embodiment of the invention, to strengthen the attachment of the loop seizing point to the annular frame, at least the bottom portion of the first wall of the above described notch, which wall is generally concentric with the outer circumference of the frame, extends forward at least about one-third the minimum circumferential length of the downwardly extending supporting lug.

An essential feature of the present invention is a continuation portion of the downwardly extending supporting lug below and adjacent the bottom end of the above described smoothly curved junction, with the curved junction merging smoothly into the continuation portion, (1) to provide a smooth guide surface for any needle thread loops that may fall slack from the tapered forward end base portion during normal operation of the sewing machine and (2) to provide a smoothly shaped barrier to keep such slack loops from passing partly or entirely beneath the lug. Two specific embodiments of such a continuation portion are disclosed the first type of continuation portion being included in the embodiment of FIGS. 1, 3 and 4 and in the embodiment of FIG. 2, and the second type of continuation portion being included in the embodiment of FIGS. 11 and 12.

Means is provided for reliable and accurate attachment of the loop seizing point to the frame. This attachment means is located entirely rearward of the reduced forward end of the loop seizing point.

The loop seizing point described just above is defined in the claims both in combination with the other elements of the rotary loop taker and as a subcombination of the whole invention. The rotary loop taker may be manufactured and sold as a complete product, or separate loop seizing points may be manufactured and sold as replacement parts for use when the original loop seizing point becomes worn, chipped or otherwise damaged.

BRIEF DESCRIPTION OF THE DRAWINGS

This invention will now be described with reference to the attached drawings in which:

FIGS. 5–10 are top plan views of the rotary loop taker of FIG. 4, showing the needle in its fixed horizontal position, and the rotating loop taker and the needle thread loop that has been taken up by it in the approximate successive positions occupied by them as the rotary loop taker goes through one full rotation after it has taken up the thread loop;

FIG. 11 is an enlarged, three-quarters perspective view from the top of a third embodiment of the rotary loop taker of this invention; and FIG. 12 is a side elevation of the rotary loop taker of FIG. 11.

DETAILED DESCRIPTION OF THREE EMBODIMENTS

General Construction of Rotary Loop Taker

Figure 1:
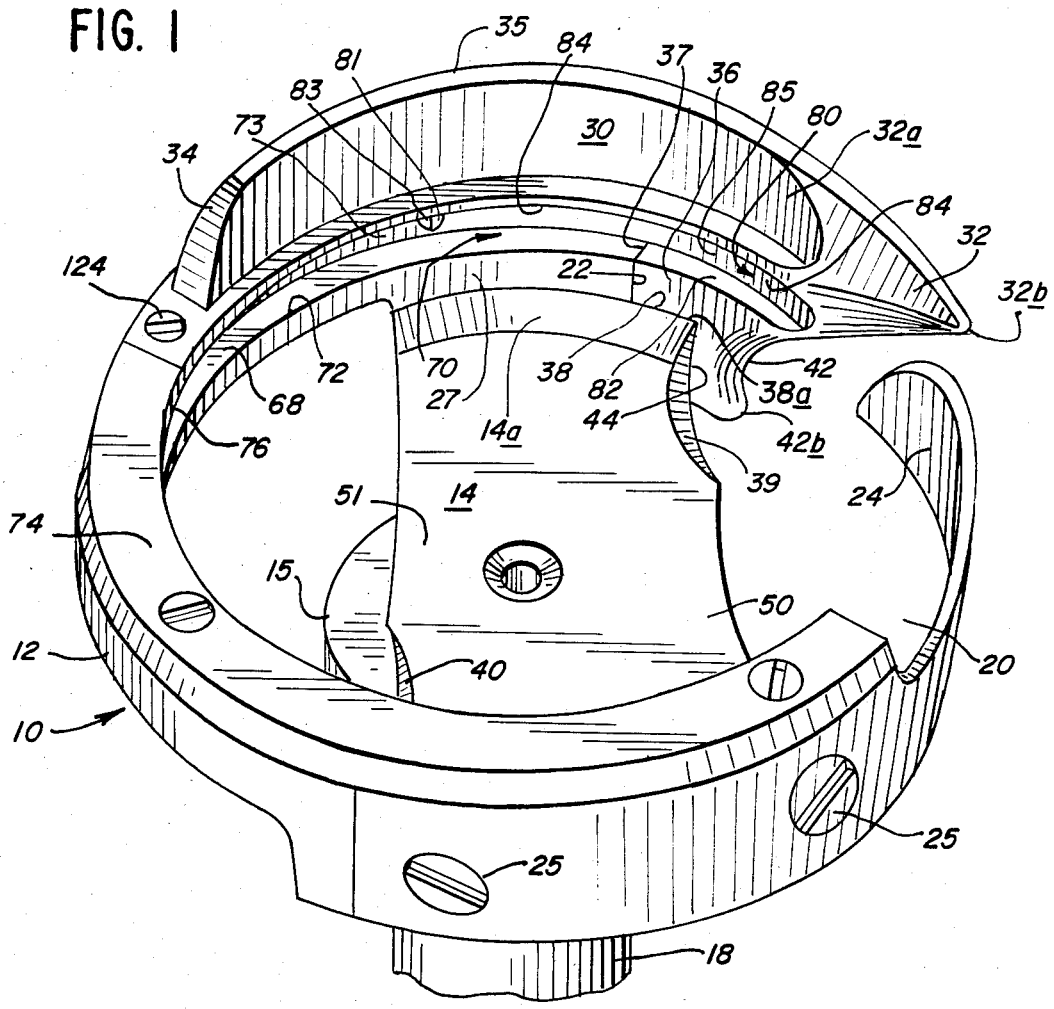
FIG. 1 is an enlarged, three-quarters perspective view from the top of one embodiment of the rotary loop taker of this invention.

FIG. 1 is an enlarged, three-quarters perspective view of one embodiment of the rotary loop taker of this invention, indicated by the numeral 10, in the vertical position it occupies when in place in a lockstitch sewing machine of conventional construction in which the take-up device (not shown in this Figure) is located above the bobbin case (also omitted for clarity here, and shown only in certain fragmentary views in other Figures, as explained below) of the machine.

Figure 3:
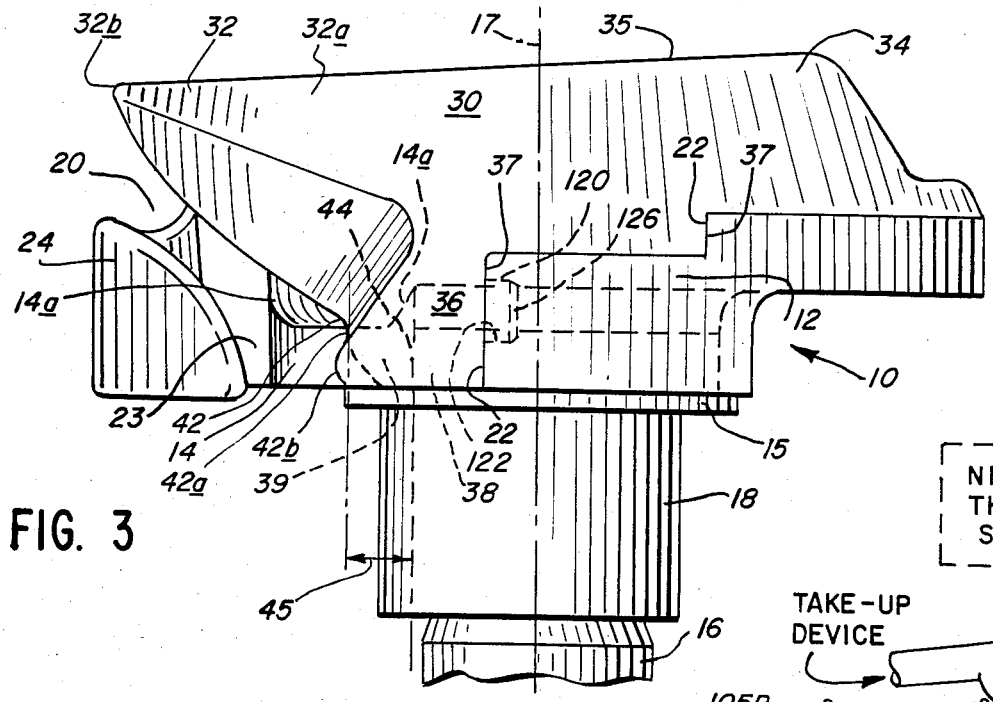
FIG. 3 is a side elevation of the rotary loop taker of FIG. 1.

Loop taker 10 includes substantially annular frame 12, which is supported by crosswise support member 14 extending from one side of the frame to the other. Crosswise support member 14 is in turn attached to rotatable shaft 16, at generally right angles thereto, through disk 15 and hub 18 (FIG. 3). When this embodiment of rotary loop taker 10 is in use in a lock-stitch sewing machine, axis 17 of shaft 16 is oriented in a vertical position.

As seen in FIGS. 1 and 3, shaft 16 is attached, through hub 18 and disk 15, to the bottom surface of crosswise extending support member 14. This arrangement of parts provides means for rotatably supporting frame 12 in the lock-stitch sewing machine. Rotatable shaft 16 is in turn connected to the actuating mechanism of the sewing machine, and during use of the machine is rotated about its axis 17 to cause frame 12 to rotate in a predetermined plane about the associated bobbin case.

A portion of substantially annular frame 12 is cut away along one segment of its circumference. As seen in FIGS. 1 and 3, opposing end walls 22 and 23 of frame 12 face upon, and define, cut-away portion 20.

In a lock-stitch sewing machine the needle penetrates the material being sewed and when it starts to withdraw from that material forms on the underside of the material a loop of needle thread which is hooked by the loop seizing point of the rotary loop taker as the latter begins a revolution. The loop of needle thread is then passed around the bobbin case as the loop taker rotates, to be pulled off by the take-up device near the end of a full revolution of the loop taker. Cut-away portion 20 of frame 12 provides space for the needle thread to exit from the loop seizing point and to be pulled away from the bobbin case as rotary loop taker 10 completes its revolution and the needle thread is pulled off the loop seizing point by the take-up device. The successive positions of the needle thread loop as the rotary loop taker revolves are illustrated in FIGS. 4–11, discussed below.

Needle guard 24 extends from frame 12, to which it is attached by screws 25, into frame cut-away portion 20.

Loop Seizing Point With Downwardly Extending Lug

Detachable loop seizing point 30 is mounted on frame 12. It has generally the same curvature as substantially annular frame 12. Tapered forward end 32 extends into cut-away portion 20 of frame 12, and rear portion 34 extends in the other direction along annular frame 12.

Tapered forward end 32 includes base portion 32*a*, which portion has the broadest transverse dimensions of member 32. Member 32 tapers from the base portion to its smallest transverse dimensions at its free end 32*b*.

Lug 36 extends directly downward from detachable loop seizing point 30, generally midway between the front and rear ends of the loop seizing point, from immediately behind base portion 32*a* of tapered forward end 32. The lug extends into cut-away portion 20 of frame 12, and has a rearwardly facing surface 37 that abuts end wall 22 of the frame, which is at the trailing end of cut-away portion 20 when the rotatable shaft rotates in the clockwise direction as seen in FIG. 1 during opetion of the sewing machine.

Lug-Receiving Notch

The above mentioned frame support member 14 extends crosswise of substantially annular frame 12, with its edge portion 50 facing cut-away portion 20 of frame 12. In the embodiment shown, beveled surfaces 14*a* are located at the juncture of each end of member 14 with inner wall 27 of substantially annular frame 12.

Edge portion 50 of support member 14 and frame end wall 22, which is at the trailing end of cut-away portion 20 during forward rotation of the frame, define a notch for receiving downwardly extending supporting lug 36. This lug-receiving notch has a first wall 38 that is generally concentric with the outer circumference of frame 12, and at its outer end 38*a* is at least as far from the center of frame 1as is inner wall 27 of the frame. The second wall of the notch is comprised of end wall 22 of frame 12, which is generally radially positioned with respect to the frame. The lug-receiving notch extends inwardly from the outer circumference of frame 12, along the frame in an angular direction opposite to the direction of forward rotation of the frame, and axially entirely through support member 14.

Figure 4:
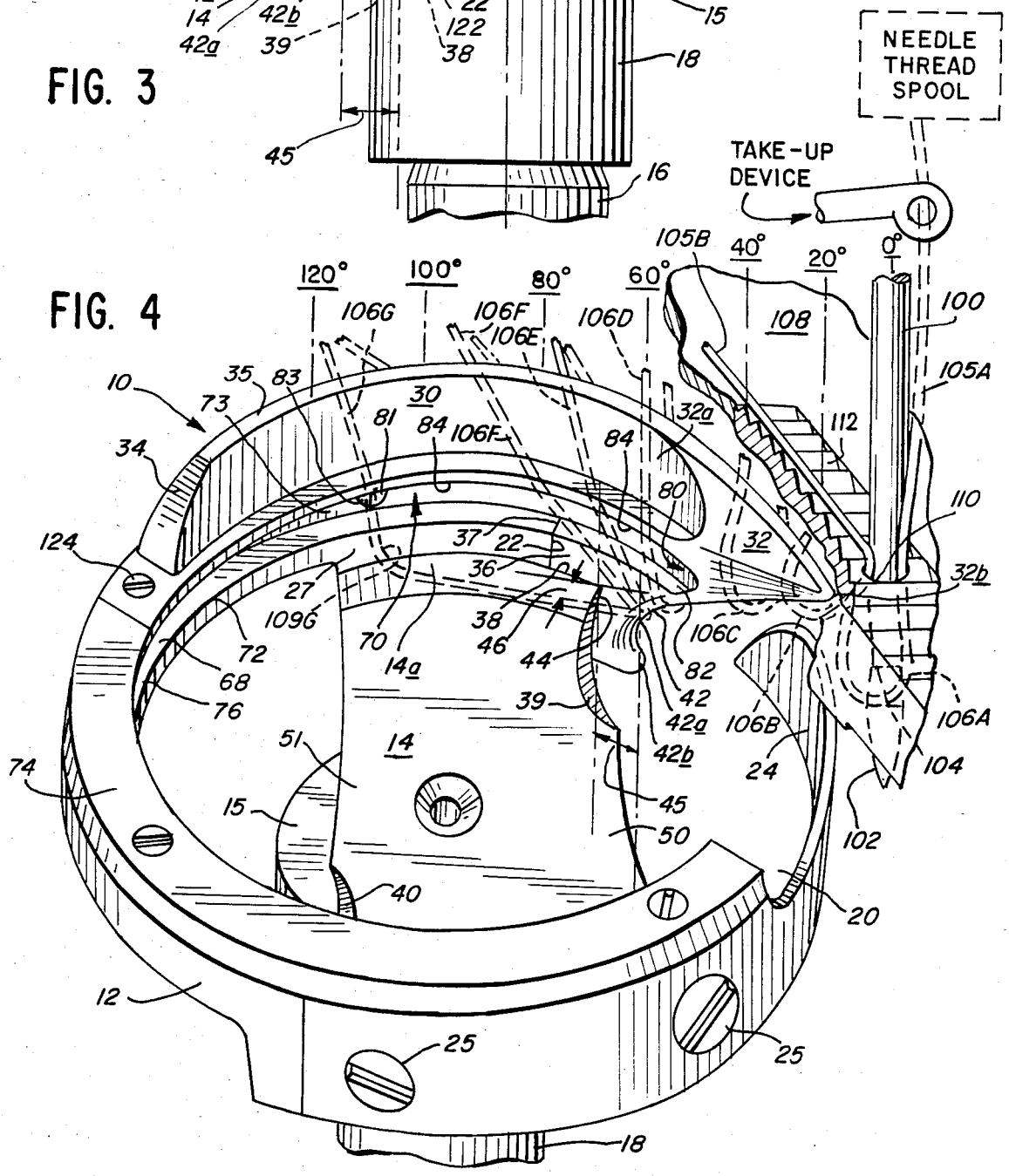
FIG. 4 is a view similar to FIG. 1, with the addition of a needle and its associated thread shown in full line just before the rotary loop taker takes a loop of needle thread off the needle, and with successive relative positions of the loop of needle thread with respect to the rotating loop taker shown in phantom.

In the embodiment of the rotary loop taker of this invention shown in FIGS. 1, 3 and 4, the forward boundary of first wall 38 of the lug-receiving notch is defined by beveled surface 39 in edge portion 50 of crosswise extending support member 14. The diametrically opposite end of member 14 includes counterbalancing beveled surface 40 in edge portion 51 of member 14. Downwardly extending supporting lug 36, first notch wall 38, and beveled surface 39 form crack 44 at the forward end of the area of abutment of lug 36 against the remainder of the rotary loop taker, i.e., edge portion 50 of crosswise extending support member 14.

Figure 2:
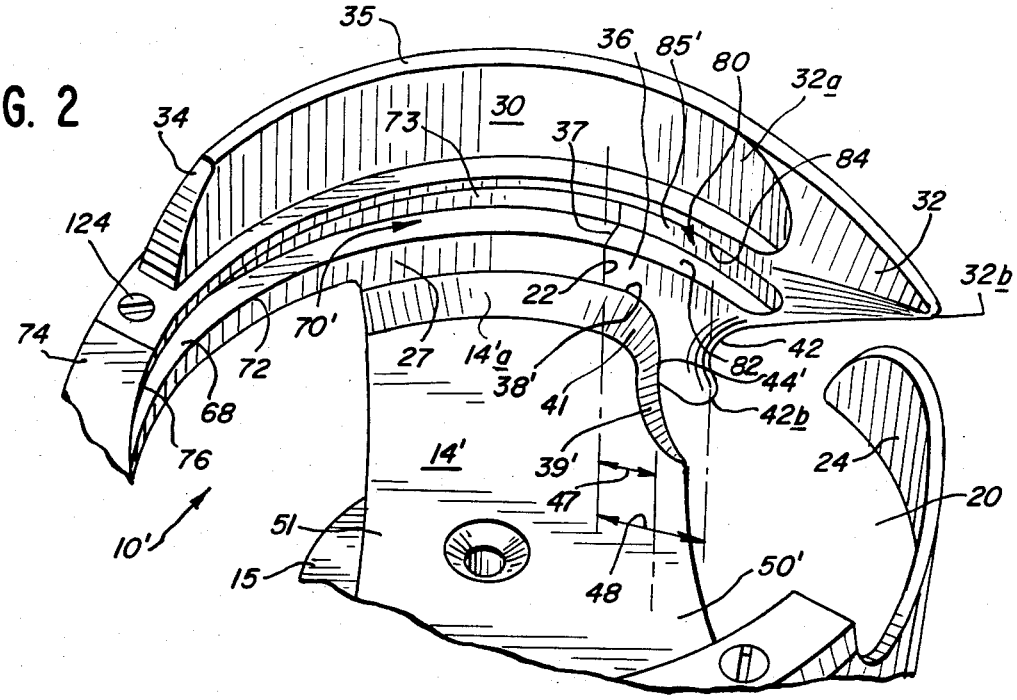
FIG. 2 is a similar but fragmentary view of a second embodiment of the rotary loop taker of this invention.

In the embodiment of FIG. 2, upper end portion 41 of beveled surface 39′ is rounded off. As a result, crack 44′ between downwardly extending supporting lug 36 and wall 38′ of edge portion 50′ of crosswise extending support member 14′ is of course also rounded at its upper end.

Beveled surface 39 may if desired be positioned to form cut-out portions of other shapes, so long as the relationship between various parts of the rotary loop taker that will be described below is present. The surface does not have to be beveled, and can for example be a vertical plane or other boundary surface if desired.

The omission from the above mentioned Dickson and Thiermann devices of a notch in which the downwardly extending supporting lug of the rotary loop taker can nest is one of the reasons for the failure of those prior art devices.

Form and Dimensions of Loop Seizing Point

Referring again to FIGS. 1, 3 and 4, detachable loop seizing point 30 is integrally formed from tapered forward end 32 to the rear end of rear portion 34. Tapered forward end 32, which extends forwardly of downwardly extending lug 36, is a single, smoothly shaped, integrally formed element. Rear portion 34 of loop seizing point 30 extends rearwardly of lug 36 for a distance greater than the distance tapered forward end 32 extends forward of the lug.

The overall length of loop seizing point 30 measured from the tip of its forward end 32 to the rear end of the rear portion 34 may be a minor portion of the circumference of annular frame 12. In the embodiments shown in the drawing, the over-all length of loop seizing point 30 and 30″ is approximately one-third of the circumference of frame 12. Depending upon the particular type of rotary loop taker involved, the loop seizing point may sometimes be only approximately one-quarter of the circumference of frame 12 in length. On the other hand, in some embodiments it may be more than a minor portion of the circumference of the frame.

The loop seizing point should be at least about as long as indicated for three reasons. First, no breaks in the surface of the loop seizing point should be interposed in the path that is followed by the loop of needle thread as it is picked up from the needle and is slid back along forward end 32 toward downwardly extending lug 36, and across top ridge 35 of the loop seizing point and the top surface of gib 74 (as best seen in FIGS. 4–11, discussed below). Second, rear portion 34 of the loop seizing point should be substantial enough in size to provide a secure attachment to frame 12 or 12″. Third, for convenience of manufacture and installation, the loop seizing point should ordinarily be no longer than is required by the first two considerations just mentioned.

In any event, rarwardly extending rear portion 34 and its top ridge 35 are preferably smoothly shaped, with no seams or joints, throughout their length.

As is seen from the various Figures of the drawing, the maximum thickness of base portion 32*a* of tapered forward end 32 of the loop seizing point measured radially of annular frame 12 or 12″ adjacent downwardly extending supporting lug 36 is substantially equal to the maximum thickness of the frame measured in the same radial direction. This will help provide strength, rigidity and stability to tapered forward end 32 under the rigorous conditions of use in a typical industrial lockstitch sewing machine.

Form and Dimensions of Downwardly Extending Lug

As stated above, rearwardly facing surface 37 of downwardly extending lug 36 abuts end wall 22 of frame 12, which is at the trailing end of cut-away portion 20 during forward rotation of the frame. Since loop seizing point 30 is secured to frame 12 in a fixed position, this abutting relationship continues at all times. As is shown by FIGS. 1 and 3, this abutting relationship extends throughout substantially the entire height of supporting lug 36, and throughout substantially the entire forwardly facing surface of frame end wall 22 as well.

Abutting surfaces 22 and 37 may be planar (FIG. 2), stepped (FIGS. 3 and 12), or any other desired shape so long as they are complementary in shape and abut each other at all times.

Lug 36 and the surface of end wall 22 against which it abuts form at least a close fit at all times, and preferably a snug fit. The abutting surfaces of lug 36 and frame end wall 22 are generally normal, and preferably substantially normal, to the outer circumference of annular frame 12.

As will be seen, the abutting relationship between the mass of downwardly extending lug 36 and frame end wall 22 provides a solid and reliable support for detachable loop seizing point 30. For best results, it is important that this mass be quite substantial in order for a sufficiently stable and secure attachment to be effected between loop seizing point 30 and frame 12 that detachable member 30 will be able to withstand the quite severe mechanical stresses to which it is subjected during normal operation of a commercial sewing machine. Thus, it is preferred that the maximum thickness of lug 36 measured radially of annular frame 12 be substantially equal to the maximum thickness of frame 12 measured in the same direction. It is further preferred that the length of lug 36 measured along the outer circumference of annular frame 12 be at least substantially equal to the maximum radial thickness of frame 12, and that the depth of the downwardly extending lug measured axially of frame 12 also be at least substantially equal to the maximum radial thickness of the frame.

It is also preferred that supporting lug 36 extend upward to, but not above, the vicinity of the vertical midpoint of base portion 32*a* of tapered forward end 32. This arrangement of parts will strengthen the attachment of the loop seizing point to its annular frame because it places the mass of the annular frame that is bounded by forwardly facing end wall 22 (or 22″) not only behind the bottom portion of downwardly extending supporting lug 36 (or 36″) but also behind that portion of the lug that lies behind and below the vicinity of the vertical midpoint of base portion 32*a* of tapered forward end 32 of the loop seizing point (FIGS. 3 and 12).

This is not true of the above mentioned Dickson patent, and as a result the extremely large shear forces applied in that device to lug 17 by face 18 of annular frame 10 from time to time during the typical operation of an industrial sewing machine at very high rotational speeds must be absorbed entirely by the downwardly extending supporting lug, and not to any extent by the base portion of the tapered forward end of the loop seizing point. Every way in which the attachment of the detachable loop seizing point to the annular frame of the rotary loop taker can be strengthened is extremely important in light of the very large distorting and destructive forces to which a loop seizing point is subjected during everyday use of an industrial sewing machine.

The inwardly facing surface of supporting lug 36 or 36″, including any member integrally formed with the lug, is at least as far from the center of annular frame 12 or 12″ as inner wall 27 or 27″, respectively.

Smoothly Curved Junction

As is seen in FIGS. 1, 3 and 4, downwardly extending supporting lug 36 forms a smoothly curved junction 42, without any seams or joints, with base portion 32*a* of tapered forward end 32 of loop seizing point 30. This smoothly curved junction guides the loop of needle thread that is picked off the needle by the loop seizing point, as the thread loop moves from tip 32*b* of tapered forward end 32 down to its base portion 32*a* and back to the tip again.

The rearwardmost position 42*a* that is taken by needle thread loop 106 as it moves down and back up on base portion 32*a* of tapered forward end 32 of loop seizing point 30 is seen from FIGS. 3 and 4 to be approximately level, in this embodiment, with the main top surface of crosswise extending support member 14, exclusive of beveled portion 14*a*.

In designing a rotary loop taker in accordance with the teaching of the present invention, the location of needle thread loop rearwardmost position 42*a* on smoothly curved portion 42 can be determined simply and accurately by reference to the particular integrally formed rotary loop taker for which the loop taker with a detachable loop seizing point is to be substituted. The integrally formed rotary loop taker is installed in a sewing machine in the conventional manner, the machine is hand actuated in "slow motion," and position 42*a* is noted and marked, as for example with a felt-tipped pen, on curved portion 42.

The location of position 42*a* can be determined in the same way on curved portion 42 of a rotary loop taker that has already been designed and fabricated with a detachable loop seizing point, when the question to be determined is whether that loop taker comes within the definition contained in the claims of a patent issued on this application.

Location of Smoothly Curved Junction

The rearwardmost position 42*a* on smoothly curved junction 42 to which the needle thread loop is pulled by the rotating loop taker lies a first predetermined distance 45, measured substantially horizontally along downwardly extending supporting lug 36, from the nearest point on crack 44 formed by lug 36 and first wall 38 of the lug-receiving notch against which the lug abuts. As seen from FIG. 4, distance 45 is measured in a substantilly horizontal direction because the point on carck 44 that is nearest to needle thread loop rearwardmost position 42*a* lies in substantially th same plane as does that rearwardmost position of the thread loop.

In the design of a rotary loop taker according to the teaching of the present invention, the location of position 42*a* is first determined as described just above, and the desired location of crack 44 in reference to position 42*a* is then established. This can be done by further hand actuation of the sewing machine having the corresponding integrally formed rotary loop taker installed therein, with the operator taking note of the distance 45 (measured along the downwardly extending supporting lug) that under all the circumstances present will keep the taut needle thread loop a safe diagonal or horizontal distance 46 (measured normal to the taut thread) away from the nearest point on inverted L-shaped crack 44 when that crack will be formed, in the resulting loop taker fabricated according to this invention, between supporting lug 36 and the remainder of the rotary loop taker. (See FIG. 4, where distance 46 is indicated as measured in the horizontal direction.) Distance 45 will be, in other words, at least the distance that is observed to be sufficient to produce the minimum distance 46 that will avoid snagging the needle thread loop in crack 44 during normal operation of the sewing machine.

More particularly, first predetermined distance 45 will be determined by (1) which one of the various types of rotary loop takers that are used in lock-stitch sewing machines is the one with which this detachable loop seizing point is used, (2) the successive angles of inclination with respect to the horizontal through which needle thread loop segments 106 move as the loop is pulled back on the loop seizing point, (3) the successive angles measured in a horizontal plane with respect to inner wall 27 of annular frame 12 through which segments 107 move as they are pulled still farther back on the loop seizing point and under the bobbin case, (4) the diameter of the thread (which for industrial sewing machines is typically about 1/32" to 3/64") with which the invention is to be practiced, (5) the flexibility of the thread, (6) the tension that will be exerted on the thread throughout operation of the sewing machine, and (7) the tightness of the twist of the thread that is to be used. Keeping these factors in mind, one skilled in the art who is designing a rotary loop taker according to this invention will determine distance 45 (FIG. 4) through application of the principles of the invention, so as to achieve the two objectives of (1) a non-snagging construction, and (2) strong, secure attachment of the detachable loop seizing point to the remainder of the rotary loop taker.

In one embodiment of the rotary loop taker of this invention that includes a substantially annular frame having an inner diameter (from wall 27 to the diametrically opposite wall in FIG. 1) of approximately 27 mm., good results are obtained (with thread having a diameter and tightness of twist typical of those commonly used with industrial sewing machines) when substantial distance 45 between crack 44 and needle thread loop rearwardmost position 42*a* is at least about 1 mm. Improved results are obtained when the distance in question is at least about 2 mm., and it is preferred that the distance be at least about 3 mm. The distances indicated are, in other words, at least about 1/27, 1/13, and 1/9, respectively, of the predetermined inner diameter of the substantially annular frame of the rotary loop taker.

FIGS. 11 and 12 illustrate a third embodiment of the rotary loop taker of this invention, in which first determined distance 45" (in FIG. 11) between needle thread loop rearwardmost position 42"*a* and crack 44" formed by lug 36" and lug-receiving notch first wall 38" is about 3 mm. when angular frame 12 has an inner diameter of about 27 mm. In this embodiment, distance 45" (measured along downwardly extending supporting lug 36") from the nearest point on crack 44" to needle thread loop rearwardmost position 42"*a* is measured in a substantially vertical direction or on a slight diagonal, rather than generally horizontally in the direction of tapered forward end 32, as distance 45 is measured in the embodiment of FIG. 4 discussed just above. Here again, as in the case of the embodiment of FIG. 4, the direction in which the first predetermined distance 45" is measured is determined by the location of the point on crack 44" (which in this case is end portion 38"*a* ) that is nearest to needle thread rearwardmost position 42"*a* . When first predetermined distance 45" is measured in a diagonal direction, it should be slightly larger (because of the geometrical relationships involved) than when it is measured in a vertical direction. As will be seen, in this embodiment second distance 46" (measured normal to the taut thread) is very nearly the same as distance 45" (measured along supporting lug 36").

As explanined above in the section entitled "SUMMARY OF THE INVENTION," in the rotary loop taker of this invention the first predetermined distance between the neeedle thread loop rearwardmost position and the crack formed by the downwardly extending supporting lug and the substantailly annular frame against which it abuts, measured in any direction, has a specified relationship to the inner diameter of the substantially annular frame. A ratio of at least about 1/27 between this first distance and the annular frame inner diameter is satisfactory, a ratio of at least about 1/13 produces improved results, and a ratio of at least about 1/9 (3 mm. to 27 mm., for example, as in the embodiment of FIGS. 11 and 12 just described) is preferred.

As will be pointed out below in connection with FIGS. 4–11, the defined location of smoothly curved junction 42 or 42" is of great importance in avoiding snagging the needle thread loop in any crack or gap that is present either rearward of, or below, base portion 32*a* of tapered forward end 32 of the loop seizing point.

Continuation Portion Below Smoothly Curved Junction

Downwardly extending supporting lug 36 or 36" has a continuation portion below and adjacent the bottom end of smoothly curved junction 42 into which the curved junction merges smoothly. The purpose of this continuation portion is (1) to provide a guide surface for any needle thread loop that falls slack from the tapered forward end base portion and moves downward to the lowest position it occupies during normal operation of the sewing machine, and (2) to provide a smoothly shaped barrier to keep any such slack loop that moves downward to that lowest position from passing partly or entirely beneath the bottom of the downwardly extending supporting lug which lug extends downward from the detachable loop seizing point separate from the substantially annular frame and the means for rotatably supporting the frame.

In the embodiment of this invention shown in FIGS. 1, 3 and 4 and in the embodiment of the invention shown in FIG. 2, curved junction 42 merges smoothly into smoothly rounded, protuberance 42*b*, which extends in the circumferential direction forwardly into said cut-away portion of substantially annular frame 12 below and adjacent the bottom end of the curved junction. Protuberance 42*b* comprises the supporting lug continuation portion referred to just above.

In these two embodiments shown in FIGS. 1, 3 and 4 and in FIG. 2, the forwardly extending protuberance is generally hemispherical in shape. Thus, as seen in FIGS. 1, 2 and 4, the forward portion of protuberance 42*b* adjacent cut-away portion 20 of annular frame 12 faces that cut-away portion is a circumferential direction with a smoothly curved, convex cross-section in any plane perpendicular to the axis of the rotary loop taker.

Smoothly rounded protuberance 42*b* functions to restrain sliding movement of the needle thread loop below curved junction 42 during operation of the sewing machine. The purpose of this restraint is to avoid certain dangers that are present in the above mentioned Dickson and Thiermann devices, because in those devices there is no smoothly shaped member at the bottom of the downwardly extending supporting lug that would keep the needle thread loop from falling partly or entirely below the bottom of the lug when for some reason the thread loop falls slack from the tapered forward end base portion during normal operation of the sewing machine. The thread loop may go slack in this way when the sewing machine is reversed upon occasion or, as is more common, when it is suddenly stopped as at the end of a seam.

The dangers that are avoided by smoothly rounded protuberance 42*b* will be presented if a slack thread loop slips partly under the bottom of the downwardly extending support lug and gets caught on the inside corner of that lug, or if the slack thread loop slips entirely under the loop seizing point and annular frame. In either case, when the thread loop slips under the downwardly extending supporting lug, it can get snagged against accumulated debris lying in the saddle in which the annular frame is positioned, or against the upper part of the saddle itself. In addition, with those rotary loop takers in which the needle guard includes a full plate beneath the annular frame, the plate forms a crack with the bottom of the annular frame where a slack thread loop that has slipped under the downwardly extending supporting lug can get snagged, especially when the sewing machine is started up abruptly after having been temporarily stopped.

In all these cases, the thread may be broken, or the snagging of the thread may produce the serious condition known as "thread lock."

In the embodiment shown in FIGS. 11 and 12, the continuation portion below and adjacent the bottom end of smoothly curved junction 42″ comprises a portion of downwardly extending lug 36″ in the form of member 43. This member has the following characteristics with respect to its shape and dimensions: (1) Its forward portion has a smoothly curved, convex cross-section in any plane perpendicular to the axis of rotation of the rotary loop taker. (2) It has a substantially straight profile as viewed from the geometric center of the rotary loop taker. (3) It extends downward for the above described first predetermined distance, which is beyond the point to which any needle thread loops may reach that fall slack from base portion 32*a* of the tapered forward end of the loop seizing point during normal operation of the sewing machine. (4) The bottom portion of the member extends at least as far forward as the other portions thereof. Continuation portion 43 helps to avoid letting slack thread loops pass partly or entirely beneath lug 36″ by extending the guide surface upon which the needle thread loop may slide to a point that should accommodate any condition of slackness in the needle thread loop that is likely to occur during normal operation of the sewing machine.

As shown in FIGS. 11 and 12, continuation portion 43 merges into bottom portion 36″*a* of downwardly extending supporting lug 36″. The inwardly facing surface of lug bottom portion 36″*a* abuts at all times substantially the entire outwardly facing surface of first wall 38″ of the lug-receiving notch, to help provide a strong and secure attachment of the loop seizing point to the substantially annular frame.

If the operating conditions of the sewing machine are such that it is not necessary to provide the extra strength of attachment of the loop seizing point to the substantially annular frame that is provided by the above described notch with a supporting lug nested therein, this feature may be omitted if the curved junction, continuation portion (of either type described), and merging relationship between these two elements, all as defined above, are present. In the embodiments of FIGS. 1–4, for example, curved junction 42 and rounded protuberance 42*b* will be effective to guide the needle thread loop and avoid snagging it on any cracks adjacent or below the downwardly extending supporting lug of the loop seizing point. In the embodiment of FIGS. 11 and 12, curved junction 42 and downwardly extending member 43 will provide a similarly effective guide surface for the needle thread loop.

Rotation of Loop Taker Adjacent Vertically Reciprocating Needle

The great importance of the location of smoothly curved junction 42 in avoiding getting needle thread loops caught or snagged, as just mentioned, can best be understood by reference to FIGS. 4–11. These figures illustrate how forward end 32 of loop seizing point 30 or 30″ of rotary loop taker 10 or 10″ picks up a loop of needle thread as it rotates past needle 100, and carries the loop around until it is released near the end of one full revolution of the loop taker.

In FIGS. 4 and 11, needle 100 is located at the right-hand side of the Figure, with needle thread loop 106*a* shown passing through needle eye 104. Throat plate 108 (which is part of the sewing machine table) is shown positioned above rotary loop taker 10 and 10″, respectively, with the slide plate (which covers the bobbin case and rotary loop taker during operation of the sewing machine) omitted for clarity. A fragmentary showing of feed dog 112, which has a saw tooth surface to engage the material being sewed, is included in these Figures. Needle 100 passes through aperture 110 in throat plate 108 as it follows the vertically reciprocating path now to be described.

In industrial sewing machines of the "drop feed" type, which are ordinarily used for sewing lightweight fabrics or other lightweight materials, the needle moves up and down vertically but is wholly stationary in all horizontal directions. In machines of the "needle feed" type, which are ordinarily used for sewing heavier weight materials, in addition to its vertical movement the needle moves back and forth horizontally a short distance to help move the material along as it is being sewn. The rotary loop taker of this invention may be used with sewing machines of either type, but for illustrative purposes it is shown in FIGS. 4–11 in the accompanying drawings as used with a machine of the drop feed type.

During operation of the drop feed sewing machine, needle 100 remains fixed in horizontal location but moves up and down in vertically reciprocating motion as it penetrates and withdraws from the material being sewn. Although needle 100 does not actually move horizontally, for clarity it is indicated in FIGS. 4 and 11 as if it is moving constructively, or in other words relatively, with respect to rotating loop taker 10 or 10″, as the case may be. In these Figures, rotary loop taker 10 and 10″ are shown as if they were stationary, with needle 100 occupying successive positions around the loop taker, first from right to left (in the embodiments shown, from 0° to 120°) and then later (not indicated in these Figures) from left to right. The fact is, of course, that the needle is completely stationary in horizontal location and it is the loop taker that rotates—in FIGS. 4 and 11, in a clockwise direction.

The position of needle 100 as shown in FIGS. 4 and 11 is considered the 0° position, which is just before needle thread loop 106 is engaged by rotating loop seizing point 30. During the operation of the sewing machine, needle 100 has actually moved vertically from its lowest position at −40° and up through −20° to the 0° position, and will continue to move beyond that position around a circle, in terms of relative motion with respect to rotary loop taker 10 or 10″. Later vertical positions of the needle with respect to the rotating loop taker are omitted for clarity. Needle 100 rises in its actual vertical movement until or in other words at about −40° in relation to its next constructive revolution.

During the second constructive revolution of needle 100 in terms of relative motion with respect to the rotary loop taker, the needle moves downward until it reaches the 320° position, or the −40° position with respect to the third revolution. At this point, it is again at its lowest point in its actual vertical reciprocating motion.

The successive positions of needle thread loop 106 are shown—starting with loop 106A drawn in solid line in the 0° position and loops 106B and following drawn in phantom in the 20° and succeeding positions in FIGS. 4 and 11 and drawn in solid line in FIGS. 5–10—as the loop is picked up by the loop seizing point and carried around through approximately one revolution of the rotary loop taker.

Growth and Contraction of Needle Thread Loop

The take-up device of the sewing machine, which is located above the bobbin case and throat plate 108, plays a central part—together with its associated tension assembly—in the production of needle thread loop 106. The take-up device is shown schematically in FIG. 4, and its connection with needle thread loop 106A, for example, is indicated at upper thread segment 105A. Thread segmnt 105A passes through the take-up device, and extends from there through the associated tension assembly to the spool of needle thread elsewhere on or near the machine. The other end 105B of thread loop 106A is shown extending along feed dog 112 and above throat plate 108.

While rotary loop taker 10 or 10″ is rotating with respect to needle 100 and the needle is reciprocating vertically, as described above, the take-up device and its associated tension assembly are adjusted to permit needle thread to pay out during the first half revolution of the rotary loop taker in order to permit loop 106 to grow in size as the motion of the rotary loop taker pulls additional thread through needle eye 104, thus producing needle thread loop of expanding size. Thereafter, during the second half of the revolution of the rotary loop taker, the take-up device is adjusted to take up needle thread, to cause loop 106 to become smaller until the rotary loop taker reaches a point at which the loop can be pulled off the free end of the loop seizing point.

This action of the rotary loop taker and the take-up device and its associated tension assembly which results in loop 106 first growing larger and then being reduced in size is best seen in FIGS. 5–10. As seen there, loop 106 grows in size from the time it is taken up by rotary loop seizing pont 30 until just before rotating loop taker 10 and needle 100 are in about their 240° relative position, and then the loop contracts as that relative position changes about 360°. In the embodiment shown, as needle 100 moves up and down during the second revolution of rotary loop taker 10, needle thread loop 106 is pulled up by the take-up device and its associated tension assembly, to tighten the loop around the bobbin thread and secure the resulting lock-stitch against the material being sewed.

Successive Shapes Assumed by Needle Thread Loop

Loop 106B, shown in perspective in FIGS. 4 and 11, is the approximate shape of the needle thread loop as forward end 32 of the loop seizing point takes it off needle 100 at about the 20° position, and loop 106C has been made somewhat larger by the rise of needle 100 and the advance of rotating loop taker 10. Ordinarily the needle thread loop remains fairly loose around the loop seizing point for this first part of the advance of the rotary loop taker.

When the loop taker has advanced far enough that needle 100 is in about the 60° position as indicated in FIGS. 5–10, loop 106D has been drawn fairly taut against loop seizing point 30, although the take-up device and its associated tension assembly, as discussed above, permit the paying out of needle thread as required during this portion of the rotation of the loop taker. As indicated in FIGS. 4 and 11, when rotary loop taker 10 or 10″ has rotated far enough that needle 100 is in the 80°, 100°, and 120° positions, thread loops 106E, 106F and 106G are pulled quite taut against smoothly curved junction 42 or 42″, respectively.

As will beunderstood, after needle eye 104 has been retracted above throat plate 108, the upper segments of needle thread loop 106 take positions at their top ends that are determined by the size and relative position of aperture 110 with respective to the rotating loop seizing point. These successive positions are indicated in FIGS. 4 and 11.

In FIGS. 5–10, the successive shapes taken by needle thread loop 106 after it has been taken off needle 100 are shown in plan for almost the full 360° of rotation of rotary loop taker 10. Forward end 32 of loop seizing point 30 is shown in FIG. 5 as it is just ready to take loop 106A off needle 100, and successive positions of the rotating loop taker are shown in FIGS. 6–10. Loops 106A, 106D and 106G are shown in plan view in FIGS. 5–7 in the respective positions that they occupy as shown in FIG. 4 in perspective. Needle thread loops 106J, 106M and 106P are shown in plan view in FIGS. 8–10 in the positions they occupy as loop taker 10 rotates still farther with respect to needle 100.

Sliding of Thread In Longitudinal and Transverse Directions Along and Across Tapered Forward End of Loop Seizing Point As shown in FIGS. 4–11, as the needle loop grows and diminishes in size as just described, the thread loop slides all the while in the longitudinal direction along tapered forward end 32 of loop seizing point 30 or 30″ from the tip **32*b* of member 32 to base portion 32*a* and back again, until it is pulled off member 32 (just ater the position it occupies in FIG. 10) by the take-up device. (It should be understood that the take-up device and needle thread spool shown schematically in FIG. 4 are employed also with the embodiment of the rotary loop taker of this invention that is illustrated in FIG. 11**, in which Figure they are omitted for economy of space.)

As will be seen from FIGS. 5–10, needle thread loop 106 in its various configurations is held quite taut (somewhat less so in the last half of the rotation of the loop taker) by the opposing forces of rotating loop seizing point 30 and the take-up device and its associated tension assembly, which are located above the rotary loop taker. As a result of this continuing tension on the needle thread loop—which holds the loop in taut engagement with the loop seizing point during the first half of one revolution of the loop taker, and in what may be called snug engagement during the last half—it will be seen that when the loop grows and diminishes in size as described, in addition to sliding in the longitudinal direction along tapered forward end 32 of the loop seizing point, the thread also necessarily slides in the transverse direction across the tapered forward end, along the longitudinal axis of the thread.

As seen in FIGS. 4 and 11, free end 105B of needle thread loop 106A lies above feed dog 112, anchored against the material being sewed by the bobbin thread that has been pulled tight against the needle thread to produce the previously formed lock stitches across the material. In this condition, end 105B obviously can not move. Thus it is thread segment 105A that must move down through needle aperture 110 as thread "pays out" from the needle thread spool in response to the pulling action exerted by rotating loop seizing point 30 or 30" as the loop taker rotates. Examination of FIGS. 4 and 11 makes it clear that as the needle thread is thus paid out to form loops of increasing size, the thread must slide along its length across the loop seizing point. If it did not do so, the needle thread loop would be broken by the force applied to it by the loop seizing point.

The converse is also true. When the needle thread loop is drawn snug against the loop seizing point in the last half of the rotation of the loop taker, and the take-up devce and its associated tension assembly pull the needle thread into loops of diminishing size, the thread must slide along its length across the loop seizing point. If it did not do so, it would not remain snug against the loop seizing point, but would instead flop around loosely and very likely get caught on some protuberance or other in the sewing machine and be broken.

The sliding of the thread in a needle thread loop along its length across the loop seizing point is, of course, movement in the transverse direction with respect to tapered forward end 32 of the loop seizing point.

Passing of Loop Around Bobbin Case

The objective of the forming and circling of the needle thread loop as so far described is to cast a loop of needle thread around the bobbin thread so as to form a lock-stitch as the material is sewed, with the needle thread disposed in the final stitch along the top side of the material and the bobbin thread disposed along the bottom side. This is accomplished by causing needle thread loop 106 to pass around the bobbin case as it is carried around by the rotary loop taker.

As the needle thread loop passes around the bobbin case, it necessarily is caused to encircle the bobbin thread that is being drawn out of the bobbin case. Then, when the needle thread loop is later pulled up tight around the bobbin thread, this in turn pulls the bobbin thread up tight against and partially within the material being sewed, and the lock-stitch is completed.

As will be seen from the positon of needle thread loop 106G in FIGS. 4 and 7 and the position of loops 106J and 106M in FIGS. 8 and 9, respectively, one segment of the advancing needle thread loop passes over loop seizing point 30 while another segment, indicated at 107, passes under the loop seizing point and also under the bobbin case around which the loop taker rotates. To help illustrate this, FIGS. 5–10 contain fragmentary showings of the bobbin case, including a portion of bottom wall 114 and outer cylindrical or side wall 116 (the latter shown in section).

Fragmentary portions of radially extending rib 118 carried by side wall 116 of the bobbin case are also shown in FIGS. 5–10. Rib 118, which fits loosely into raceway 70 in the inner wall of rotary loop taker 10, maintains the position of the bobbin case axially of loop taker 10 as the latter rotates about the stationary bobbin case 114/116 and past horizontally stationary needle 100. The angular position of the bobbin case is maintained by a stop (not shown) of a conventional type known to those skilled in the art.

As will be seen in FIGS. 5–10, there is a gap in rib 118 adjacent needle 100. This gap, indicated by the angle $\alpha$ in FIG. 5, may be approximately 70 degrees, 80 degrees, or the like. The major portion of the gap usually lies in front of needle 100, or below the needle as shown in FIGS. 5–10 for the embodiment illustrated. It is through this gap $\alpha$ in rib 118 that segment 107 of loop 106 is permitted to pass beneath the bobbin case as loop seizing point 30 carriethe loop around through one revolution.

Thus, FIGS. 7–9 show how bottom segments 107G, 107J and 107M, respectively, pass under bottom wall 114 of the bobbin case through the gap in radially extending rib 118. Specifically, as indicated in FIG. 7, bottom segment 107G of loop 106G passes at 109G around the bottom wall 114 and side wall 116 of the bobbin case, and from there to needle 100. In a similar way, bottom segment 107J of loop 106J passes under the bobbin case and at 109J upwards towards needle 100. Needle thread loop 106M does the same at 109M.

Critical Importance of Smoothly Curved Junction

From this explanation of the manner in which the loop seizing point takes a needle thread loop 106 off needle 100 and carries it around the bobbin case, it will be seen that the smoothly curved junction 42 or 42" without any seams or joints that is formed by the downwardly extending support lug and the base portion of tapered forward end 32 of loop seizing point 30 or 30"—and the location of that curved junction with respect to the remainder of the rotary loop taker—are both of critical importance.

As is best seen in FIGS. 4 and 11, when the needle loop threads are pulled taut against smoothly curved junction 42 or 42", they will be able to slide freely across that junction not only laterally but also along their length as further rotation of the rotary loop taker pulls more thread from the needle thread spool located above the throat plate. FIGS. 4–11 show how smoothly curved junction 42 or 42" is embraced by the taut needle thread loop at the most rearward point **42*a* or 42"*a* in its sliding movement along the tapered forward end 32 of the loop seizing point from the tip 32*b* to base portion 32*a*** and back to the tip again. If the loop of needle thread is caught in any crevice or crack along the path followed by the thread as the loop taker rotates, the snagging of the thread will break it and will sometimes cause jamming of the machine.

Except for the above mentioned commonly assigned applications, none of the prior art rotary loop takers having detachable loop seizing points have recognized, so far as appears, the critical importance not only of providing smoothly formed surfaces throughout the length of the loop seizing point but, specifically, a smoothly curved surface at this particular location on the loop seizing point. It is for this reason, among others, that the invention disclosed in the patent to Grabowski, for example, which is discussed above, has not been satisfactory.

The several vertically laminated detachable loop seizing points referred to above that have been disclosed in the prior art will also be seen to be defective because there are a number of cracks and crevices in those loop seizing points where there is a danger that the needle thread loop will be snagged or caught. This is in addition to the basic defect that laminated loop seizing points suffer because of their type of construction in not providing the same strength and stability that is achieved by the thick, sturdy, integrally formed mass of the loop seizing point of this invention.

Critical Importance of Location of Needle Thread Loop Rearwardmost Position

The significance of the location of needle thread loop rearwardmost position 42*a* or 42″*a* on smoothly curved junction 42 or 42″ in relation to the rest of the rotary loop taker has likewise not been recognized in the prior art, except in the commonly assigned applications to which reference has been made above.

In the latter applications, an inwardly extending foot is employed at the bottom of the downwardly extending supporting lug of the detachable loop seizing point. This lug foot extends inward within the crosswise extending support member for the substantially annular frame of the rotary loop taker, and (1) avoids snagging of the taut needle thread loop in the crack between the downwardly extending supporting lug and the crosswise extending support member by interposing the smoothly curved junction of which the lug foot is a part in the path of the needle thread loop as it moves down to its rearwardmost point, and (2) by the same interposition, avoids snagging of any slack needle thread loop that may fall down from the loop seizing point during operation of the sewing machine in any of various cracks to which it would be exposed if it slipped partly or entirely under the bottom end of the downwardly extending supporting lug of the loop seizing point.

Applicant has unexpectedly discovered that such a lug foot is not necessary to avoid snagging, if the spacing of the rearwardmost position of the needle thread loop on smoothly curved junction 42 or 42″ with respect to the remainder of the rotary loop taker that is defined in the appended claims is observed, and a satisfactory continuation portion as defined in the claims is also provided below the smoothly curved junction between the tapered forward end base portion and the downwardly extending supporting lug.

The reasons that the defined positioning of the rearwardmost position of the needle thread loop on smoothly curved junction 42 avoids snagging of the needle thread loop can be seen from FIGS. 4–11 of the drawing. In FIG. 4, it is seen that the relative positions of needle 100 and the rotating loop taker cause taut thread segments 106D, 106E and 106F, respectively, to be held extended almost vertically upward above crack 44 as loop 106D occupies an intermediate position, and diagonally upward above crack 44 as loops 106E and 106F reach rearwardmost position 42*a* on curved portion 42. (The thread segments are also held taut at this time well above the crack between rearwardly facing surface 37 of lug 36 and frame end wall 22.)

The distance measured normal to taut thread segments 106E and 106F between the diagonally positioned thread segment and the nearest point on crack 44 formed by the abutment of lug 36 against first notch-defining wall 38 is sufficient to avoid snagging of the thread in that crack. As can be seen from FIGS. 4 and 7, by the time thread segment 107G has been pulled under bobbin case 114 by the rotating loop taker, the relative angular relationship of needle 100 and the rotating loop taker in its 120° position has caused the thread segment to be pulled out horizontally (in FIG. 4, by distance 46) away from crack 44. (At this point, it has also been pulled horizontally away from the crack between forwardly facing surface 37 of lug 36 and frame end wall 22.) FIGS. 8–10 show that as the rotation of loop taker 30 continues, thread segments 107J, 107M, and 107P are pulled even farther away from crack 44.

Needle thread segments that are held taut at a distance away from crack 44—whether upward in a generally vertical direction or outward in a horizontal direction—cannot snag in crack 44.

Strength of Attachment of Loop Seizing Point

Another feature of the present invention achieves the advantage of avoiding any snagging of the needle thread loop, while at the same time insuring a certain minimum strength of attachment of loop seizing point 30 to the remainder of rotary loop taker 10. FIG. 1 provides one example of this feature, and FIG. 2 provides another.

In accordance with this feature, at least the bottom portion of the first wall of the lug-receiving notch extends forward, in contact with the inwardly facing surface of supporting lug 36, at least about one-third the minimum circumferential length of the supporting lug. As seen in FIG. 2, the forward boundary of first wall 38′ of the lug-receiving notch is defined by crack 44′, the bottom portion of which is located a distance 47 forward of its rear boundary at end wall 22 of frame 12. Distance 47, measured a the bottom of downwardly extending supporting lug 36, is somewhat more than about one-third the minimum circumferential length 48 of supporting lug 36.

As will be seen from FIG. 2, even if the top of notch first wall 38′ extends forward a shorter distance than about one-third the minimum circumferential length of supporting lug 36, the bottom portion of wall 38′ can still be the defined distance forward of its rear boundary at end wall 22, and the strength of the attachment of the loop seizing point can be essentially maintained.

The non-snagging feature of this invention will also be maintained if it is desired to extend the bottom portion of wall 38′ still farther forward for added strength, so long as the rearwardmost position of the smoothly curved junction to which the needle thread loop is pulled is located a substantial distance—measured either horizontally, vertically or diagonally—from the nearest point on the crack formed by the downwardly extending supporting lug and the first wall of the lug-receiving notch against which the lug abuts. This type of construction can be achieved in one way, through a modification of the embodiment of FIG. 2, by bringing only a minor vertical fraction of wall 38′ at the bottom thereof forward to abut lug 36 over a larger area than is shown in FIG. 2. It can also be achieved through the mode of construction illustrated in FIGS. 11 and 12, referred to briefly above, by bringing the entire wall 38″ forward at a lower level with respect to the curved junction.

Avoiding of Snagging With Embodiment of FIGS. 11 and 12

A comparison of FIGS. 4, 7 and 11 will show how, as a result of the construction illustrated in FIGS. 11 and 12, the needle thread loop avoids being snagged, as it is pulled along by loop seizing point 30″, in crack 44″ formed by supporting lug 36″ and first wall 38″ of the lug-receiving notch against which the lug abuts. Because needle thread loop rearwardmost position 42″*a* lies a specified minimum distance 45″ (as explained above, at least about 1/27, 1/13 and 1/9 of the inner diameter of substantially annular frame 12″ in order to achieve satisfactory, improved and preferred results, respectively) measured along downwardly extending supporting lug 36″ from the nearest point in crack 44″, the construction shown in FIGS. 11 and 12 avoids crack 44″ in the following ways:

1. When rotary loop taker 10″ is in the 60°, 80°, and 100° positions, taut needle thread segments 106D, 106E, and 106F, respectively, are held extended upward well above the nearest point on crack 44″ between lug 36″ and crosswise extending support member 14″, just as they were held well above crack 44 in the embodiment of FIG. 4. The thread segments are also held taut in this time well above the crack between rearwardly facing surface 37″ of lug 36″ and frame end wall 22″.

2. Thereafter, when needle thread segments such as segment 106G have been pulled under bobbin case 114 by the rotating loop taker (as shown in FIGS. 7 and 11), they are still held taut well above (by distance 46″, discussed above) the nearest point on crack 44″. At this point, they have also been pulled horizontally well away from the crack between rearwardly facing surface 37″ of lug 36″ and frame end wall 22″ of FIGS. 11 and 12.

Again, needle thread segments that are held spaced well above (either vertically or diagonally), or horizontally away from, crack 44″, as well as above or away from the crack between lug 36″ and frame end wall 22″, cannot snag in either of those cracks.

As explained above, continuation portion 43 extends downwardly extending supporting lug 36″ to avoid letting any needle thread loop that happens to fall down slack from the tapered forward end of the loop seizing point to the lowest position it occupies during normal operation of the machine, pass partly or entirely under the lug. This avoids the risk of the thread loop getting snagged beneath the lug in the manner discussed above. At the same time, lug bottom portion 36*a*″ helps provide the strong attachment to annular frame 12″ that is an important advantage of the present invention.

Initial Portion of Bobbin Case Raceway Defined by Detachable Loop Seizing Point As already pointed out above, the bobbin case with which the rotary loop taker of this invention is used is maintained in a substantially fixed position in the sewing machine. Bobbin case 114 may be a conventional, generally cylindrical bobbin case, as discussed above, whose side wall 116 carries rib 118 extending radially from its vertical midsection for guiding the loop taker as the latter rotates about the bobbin case (FIGS. 5–10).

The complementary structure in the rotary loop taker of this invention is raceway 70 (FIGS. 1, 2, 4, 11 and 12) that extends around inner wall 27 of circular frame 12. Lower part 68 of middle and final portions of bobbin case raceway 70 is defined by lower ledge 72 carried by inner wall 27 of circular frame 12.

Semicircular gib 74 is detachably secured to the top of frame 12. The gib defines upper part 76 of middle and final portions of raceway 70. Vertical wall 73 of raceway 70 is formed in inner wall 27, in the middle and final portions of the raceway, between lower ledge 72 at the bottom of the raceway and upper ledges 84 and 76 at the top.

In the loop seizing point of the rotary loop taker of this invention, initial portion 80 of bobbin case raceway 70 is defined by lower ledge 82 and upper ledge 84—with vertical wall 85 lying between those lower and upper ledges—all of which are formed in the inner wall of detachable loop seizing point 30 (FIG. 1). Upper ledge 84 on the inner wall of loop seizing point 30 defines the upper part of the initial portion of bobbin case raceway 70. Lower ledge 82 defines the lower part of the initial portion of bobbin case raceway 70.

As seen from FIGS. 1, 4, 11 and 12, the end of the vertical wall of initial portion 80 of bobbin case raceway 70 defined by loop seizing point 30 that lies at the trailing end of lower ledge 82 during forward rotation of annular frame 2 or 12″ may be beveled at 81, if desired. Likewise, the end of the inner wall of frame 12 or 12″ that helps to define the middle portion of raceway 70 and lies at the trailing end of cut-away portion 20 of frame 12 or 12″ during forward rotation thereof may be beveled at 83.

Means For Securing Loop Seizing Point

In the embodiments of this invention shown in FIGS. 1–4, loop seizing point 30 is detachably secured to substantially annular frame 12 by the cooperative action of positioning and retaining post 120, complementary cavity 122 (both best seen in FIG. 3), and releasable anchoring means in the form of screw 124. Post 120, preferably with beveled edge 126 at its free end, is carried by rear wall 37 of downwardly extending supporting lug 36. Complementary cavity 122 is located in end wall 22 of frame 12, which is at the trailing end of cut-away portion 20 during rotation of the frame.

Rear portion 34 of loop seizing point 30 is releasably anchored to frame 12 by releasable anchoring means or screw 124 that passes through aperture 126 and is threadably received in frame 12.

It is important that no part of the means for detachably securing loop seizing point 30 to annular frame 12 is located forward of downwardly extending supporting lug 36. Put another way, the securing means is located entirely rearward of tapered forward end 32 of the loop seizing point. This means that the detachable securing means does not ierfere in any way with tapered forward end 32 of the loop seizing point as it takes needle thread loop 106 off needle 100 and moves the loop around rotary loop taker 10 and the bobbin case.

In the embodiment of FIGS. 11 and 12, loop seizing point 30″ is detachably secured to substantially annular frame 12″ by the cooperative action of two positioning and retaining posts 120″ carried by frame end wall 22″, complementary cavities 122″ in rear wall 37″ and lug 36″, and releasable anchoring means 124.

Separate Sale Of Loop Seizing Points As Replacement Parts

As pointed out above, one of the principal advantages of the present invention is that when a loop seizing point becomes worn, chipped, broken or damaged in any other way the loop seizing point can be removed and replaced without removing any other part of the rotary loop taker. Thus, the sale of new loop seizing points as replacement parts for damaged elements in the rotary loop taker of this invention that was first sold as original equipment will be an important part of any business in which this important invention is practiced.

For the reason indicated, a group of subcombination claims is included in this application to cover the invention of the loop seizing point separately from the remainder of the rotary loop taker.

The above detailed description has been given for ease of understanding only. No unnecessary limitations should be understood therefrom, as modications will be obvious to those skilled in the art.

I claim:

1. A rotary loop taker for rotation about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having an inner wall and a predetermined inner diameter and having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) a frame support member extending crosswise of said substantially annular frame with one edge portion of said crosswise extending support member facing said cut-away portion of said frame, said one edge portion of said crosswise extending support member and the one of said frame end walls that is at the trailing end of said cut-away portion during forward rotation of said frame defining a lug-receiving notch, said notch:

(i) having a first wall that is generally concentric with the outer circumference of said frame and at its outer end is at least as far from the center of said annular frame as the inner wall of said frame, (ii) having a second wall that is generally radially positioned with respect to said frame, and (iii) extending inwardly from the outer circumference of said frame, extending along said frame in an angular direction opposite to the direction of forward rotation of the frame, and extending axially entirely through said crosswise extending support member;

(c) a rotatable shaft for said annular frame attached to said frame support member and extending at generally right angles thereto for rotating said frame about said bobbin case in a predetermined plane during operation of said sewing machine;

(d) a detachable loop seizing point mounted on said frame having generally the same curvature as said substantially annular frame, said detachable loop seizing point:

(i) being integrally formed from one end to its other end;

(ii) having a single continuously tapered, smoothly shaped, integrally formed forward end, said tapered forward end having its largest transverse dimensions in a base portion and tapering to its smallest transverse dimensions at its free end;

(iii) having a supporting lug that extends directly downward into said cut-away portion of said frame, from immediately behind said base portion of said tapered forward end, into the aforesaid lug-receiving notch in nesting relationship therewith, said supporting lug having a rearwardly facing surface and an inwardly facing surface;

the rearwardly facing surface of said supporting lug abutting at all times, throughout substantially the entire height of the lug, substantially the entire forwardly facing surface of the one of said frame end walls that is at the trailing end of said cut-away portion during forward rotation of said frame.

the inwardly facing surface of said supporting lug abutting at all times substantially the entire outwardly facing surface of said first wall of the aforesaid lug-receiving notch, said downwardly extending supporting lug forming a smoothly curved junction, free of any seams or joints, with said base portion of the tapered forward end of the loop seizing point, for guiding said loop of needle thread as it moves from the tip of said tapered forward end down to its rearwardmost position on said base portion and back to the tip again, said rearwardmost position on the smoothly curved junction to which said needle thread loop is pulled by the rotating loop taker lying a first predetermined distance measured in any direction along said downwardly extending supporting lug from the nearest point on the crack formed by said supporting lug and said first wall of said lug-receiving notch against which said lug abuts, said first predetermined distance being at least about 1/27 of said predetermined inner diameter of said substantially annular frame, to produce a second distance measured normal to said needle thread loop between said loop and said crack that will avoid snagging the needle thread in the crack when the loop is pulled taut against said smoothly curved junction during normal operation of the sewing machine, said downwardly extending supporting lug having a continuation portion integrally formed therewith and extending below and adjacent the bottom end of said smoothly curved junction, said curved junction merging smoothly into said continuation portion, the forward portion of said continuation portion adjacent said cut-away portion of the annular frame facing said cut-away portion in the circumferential direction with a smoothly curved, convex cross-section in any plane perpendicular to the axis of rotation of the rotary loop taker, to provide a smoothly shaped guide surface for any needle thread loop that falls slack from said tapered forward end base portion and moves downward to the lowest position it occupies during normal operation of the sewing machine, and to provide a smoothly shaped barrier to keep any such slack loop that moves downward to said lowest position from passing partly or entirely beneath said supporting lug which extends downward from said detachable loop seizing point separate from said substantially annular frame and said frame support member, said tapered forward end of the loop seizing point extending forwardly of said downwardly extending lug into said cut-away portion of said frame; and (iv) having a rear portion extending rearwardly of said lug along said annular frame; and (e) means for detachably securing said loop seizing point to said frame, said means being located entirely rearward of said tapered forward end of said loop seizing point.

2. The rotary loop taker of claim 1 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/13 of said predetermined inner diameter of said substantially annular frame.

3. The rotary loop taker of claim 1 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/9 of said predetermined inner diameter of said substantially annular frame.

4. The rotary loop taker of claim 1, 2 or 3 in which said continuation portion comprises a protuberance, smoothly rounded in shape, extending in the circumferential direction forwardly into said cut-away portion of said annular frame, below and adjacent the bottom end of said smoothly curved junction, said curved junction merging smoothly into said protuberance, to restrain sliding movement of the needle thread loop below said curved junction during normal operation of the sewing machine.

5. The rotary loop taker of claim 1, 2 or 3 in which said continuation portion comprises a downwardly extending member the forward portion of which has a smoothly curved, convex cross-section in any plane perpendicular to the axis of the rotary loop taker and a substantially straight profile as viewed from the geometric center of the rotary loop taker, said member extending downward beyond the point to which any needle thread loops may reach that fall slack from said tapered forward end base portion during normal operation of the sewing machine, the bottom portion of said member extending at least as far forward as the other portions thereof.

6. The rotary loop taker of claim 1, 2 or 3 in which at least the bottom portion of said first wall of said lug-receiving notch extends forward, in contact with the inwardly facing surface of said supporting lug, at least about one-third of the minimum circumferential length of said supporting lug.

7. A rotary loop taker for rotation about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, which comprises:

(a) a frame of substantially annular construction, said frame having an inner wall and a predetermined inner diameter and having a cut-away portion along one segment of its circumference to provide space for the needle thread to exit from the loop seizing point of the rotary loop taker as said thread is pulled off the loop seizing point by the take-up device, said cut-away portion being defined by opposing end walls of said frame facing upon said cut-away portion;

(b) means for rotatably supporting said substantially annular frame;

(c) a detachable loop seizing point mounted on said frame having generally the same curvature as said substantially annular frame, said detachable loop seizing point:

(i) being integrally formed from one end to its other end;

(ii) having a single continuously tapered, smoothly shaped, integrally formed forward end, said tapered forward end having its largest transverse dimensions in a base portion and tapering to its smallest transverse dimensions at its free end;

(iii) having a supporting lug that extends directly downward into said cut-away portion of said frame, from immediately behind said base portion of said tapered forward end, said supporting lug having a rearwardly facing surface and an inwardly facing surface;

said rearwardly facing surface of the supporting lug abutting at all times, throughout substantially the entire height of the lug, substantially the the entire forwardly facing surface of the one of said frame end walls that is at the trailing end of said cut-away portion during forward rotation of said frame, with said inwardly facing surface of the supporting lug being located at its forward end at least as far from the center of said annular frame as the inner wall of said frame, said downwardly extending supporting lug forming a smoothly curved junction, free of any seams or joints, with said base portion of the tapered forward end of the loop seizing point, for guiding said loop of needle thread as it moves from the tip of said tapered forward end down to its rearwardmost position on said base portion and back to the tip again, said rearwardmost position on the smoothly curved junction to which said needle thread loop is pulled by the rotating loop taker lying a first predetermined distance measured in any direction along said downwardly extending supporting lug from the nearest point on the crack formed by said supporting lug and said substantially annular frame against which said lug abuts, said first predetermined distance being at least about 1/27 of said predetermined inner diameter of said substantially annular frame, to produce a second distance measured normal to said needle thread loop between said loop and said crack that will avoid snagging the needle thread in th crack when the loop is pulled taut against said smoothly curved junction during normal operation of the sewing machine, said downwardly extending supporting lug having a continuation portion integrally formed therewith and extending below and adjacent the bottom end of said smoothly curved junction, said curved junction merging smoothly into said continuation portion, the forward portion of said continuation portion adjacent said cut-away portion of the annular frame facing said cut-away portion in the circumferential direction with a smoothly curved, convex cross-section in any plane perpendicular to the axis of rotation of the rotary loop taker, to provide a smoothly shaped guide surface for any needle thread loop that falls slack from said tapered forward end base portion and moves downward to the lowest position it occupies during normal operation of the sewing machine, and to provide a smoothly shaped barrier to keep any such slack loop that moves downward to said lowest position from passing partly or entirely beneath said supporting lug which extends downward from said detachable loop seizing point separate from said substantially annular frame and said means for rotatably supporting said frame, said tapered forward end of the loop seizing point extending forwardly of said downwardly extending lug into said cut-away portion of said frame; and (iv) having a rear portion extending rearwardly of said lug along said annular frame; and (d) means for detachably securing said loop seizing point to said frame, said means being located entirely rearward of said tapered forward end of said loop seizing point.

8. The rotary loop taker of claim 7 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/13 of said predetermined inner diameter of said substantially annular frame.

9. The rotary loop taker of claim 7 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/9 of said predetermined inner diameter of said substantially annular frame.

10. The rotary loop taker of claim 7, 8 or 9 in which said continuation portion comprises a protuberance, smoothly rounded in shape, extending in the circumferential direction forwardly into said cut-away portion of said annular frame, below and adjacent the bottom end of said smoothly curved junction, said curved junction merging smoothly into said protuberance, to restrain sliding movement of the needle thread loop below said curved junction during normal operation of the sewing machine.

11. The rotary loop taker of claim 7, 8 or 9 in which said continuation portion comprises a downwardly extending member the forward portion of which has a smoothly curved, convex cross-section in any plane perpendicular to the axis of the rotary loop taker and a substantially straight profile as viewed from the geometric center of the rotary loop taker, said member extending downward beyond the point to which any needle thread loops may reach that fall slack from said tapered forward end base portion during normal operation of the sewing machine, the bottom portion of said member extending at least as far forward as the other portions thereof.

12. The rotary loop taker of claim 7 in which said first predetermined distance is measured along said downwardly extending supporting lug in a direction lying in a plane perpendicular to the axis of rotation of said annular frame.

13. The rotary loop taker of claim 7 in which said first predetermined distance is measured along said downwardly extending supporting lug in a direction generally parallel to the axis of rotation of said annular frame.

14. A detachable loop seizing point for use in a rotary loop taker mounted to rotate about a generally cylindrical bobbin case maintained in a substantially fixed position in a lock-stitch sewing machine below the take-up device of said machine, in which sewing machine the needle provides one of the two threads that form said lock-stitch, said needle thread being taken off the needle in the form of a loop by the loop seizing point of said rotary loop taker as the loop taker rotates about the bobbin case, the vertical midsection of the side wall of said bobbin case carrying a radially extending rib for engaging the loop taker as the latter rotates about said bobbin case, said rotary loop taker including a frame of substantially annular construction on which the loop seizing point is installed, said substantially annular frame having an inner wall and a predetermined inner diameter and having a cut-away portion along one segment of its circumference to provide space for the needle thread to exit from the loop seizing point of the rotary loop taker as said thread is pulled off said loop seizing point by the take-up device, said cut-away portion being defined by opposing end walls of said frame facing upon said cut-away portion, said rotary loop taker also including a frame support member extending crosswise of said substantially annular frame, with one edge portion of said crosswise extending support member facing said cut-away portion of said frame, said one edge portion of said crosswise extending support member and the one of said frame end walls that is at the trailing end of said cut-away portion during forward rotation of said frame defining a lug-receiving notch, said notch having a first wall that is generally concentric with the outer circumference of said frame and at its outer end is at least as far from the center of said annular frame as the inner wall of said frame, and a second wall that is generally radially positioned with respect to said frame, said notch extending inwardly from the outer circumference of said frame, extending along said frame in an angular direction opposite to the direction of forward rotation of the frame, and extending axially entirely through said crosswise extending support member, which loop seizing point comprises:

(a) a single continuously tapered, smoothly shaped, integrally formed forward end, said tapered forward end having its broadest transverse dimensions in a base portion and tapering to its smallest transverse dimensions at its free end;

(b) a supporting lug that when installed in place on said substantially annular frame extends directly downward into said cut-away portion of said frame, from immediately behind said base portion of said tapered forward end, into the aforesaid lug-receiving notch in nesting relationship therewith, said supporting lug having a rearwardly facing surface and an inwardly facing surface, with:

(i) the rearwardly facing surface of said supporting lug abutting at all times, throughout substantially the entire height of the lug, substantially the entire forwardly facing surface of the one of said frame end walls that is at the trailing end of said cut-away portion of said frame during forward rotation of the same, (ii) the inwardly facing surface of said supporting lug abutting at all times substantially the entire surface of said first wall of the aforesaid notch, (iii) said tapered forward end when said loop seizing point is installed in place on said frame extending forwardly of said downwardly extending supporting lug into said cut-away portion of said frame, (iv) said lug forming a smoothly curved junction with said tapered forward end base portion, said smoothly curved junction being free of any joints of seams, for guiding said loop of needle thread as it moves from the tip of said tapered forward end down to its rearwardmost position on said base portion and back to the tip again, (iv) said rearwardmost position on said smoothly curved junction to which said needle thread loop is pulled by the rotating loop taker lying a first predetermined distance measured in any direction along said downwardly extending supporting lug from the nearest point on the crack formed by said supporting lug and said first wall of said lug-receiving notch against which said lug abuts when said loop seizing point is installed in place on said substantially annular frame, said first distance being at least about 1/27 of said predetermined inner diameter of said substantially annular frame, to produce a second distance measured normal to said needle thread loop between said loop and said crack that will avoid snagging the needle thread in the crack when the loop is pulled taut against said smoothly curved junction during normal operation of the sewing machine, and (vi) said downwardly extending supporting lug having a continuation portion integrally formed therewith and extending below and adjacent the bottom end of said smoothly curved junction, said curved junction merging smoothly into said continuation portion, the forward portion of said continuation portion adjacent said cut-away portion of the annular frame facing said cut-away portion in the circumferential direction with a smoothly curved, convex cross-section in any plane perpendicular to the axis of rotation of the rotary loop taker, to provide a smoothly shaped guide surface for any needle thread loop that falls slack from said tapered forward end base portion and moves downward to the lowest position it occupies during normal operation of the sewing machine, and to provide a smoothly shaped barrier to keep any such slack loop that moves downward to said lowest position from passing partly or entirely beneath said supporting lug which extends downward from said detachable loop seizing point separate from said substantially annular frame and said frame support member, (c) a rear portion extending rearwardly of said lug, said tapered forward end, downwardly extending supporting lug and rear portion of the loop seizing point having generally the same over-all curvature as said substantially annular frame and being integrally formed from one end to the other of the loop seizing point; and (d) means for detachably securing the loop seizing point to said annular frame, said means being located entirely rearward of said tapered forward end of the loop seizing point.

15. The detachable loop seizing point of claim 14 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/13 of said predetermined inner diameter of said substantially annular frame.

16. The detachable loop seizing point of claim 14 in which said first predetermined distance measured along said downwardly extending supporting lug between said needle thread loop rearwardmost position on said smoothly curved junction and the nearest point on said crack formed by said supporting lug and said first wall of said lug-receiving notch against which said lug abuts is at least about 1/9 of said predetermined inner diameter of said substantially annular frame.

17. The detachable loop seizing point of claim 14, 15 or 16 in which said continuation portion comprises a protuberance, smoothly rounded in shape, extending in the circumferential direction forwardly into said cut-away portion of said annular frame, below and adjacent the bottom end of said smoothly curved junction, said curved junction merging smoothly into said protuberance, to restrain sliding movement of the needle thread loop below said curved junction during normal operation of the sewing machine.

18. The detachable loop seizing point of claim 14, 15 or 16 in which said continuation portion comprises a downwardly extending member the forward portion of which has a smoothly curved, convex cross-section in any plane perpendicular to the axis of the rotary loop taker and a substantially straight profile as viewed from the geometric center of the rotary loop taker, said member extending downward beyond the point to which any needle thread loops may reach that fall slack from said tapered forward end base portion during normal operation of the sewing machine, the bottom portion of said member extending at least as far forward as the other portions thereof.

* * * * *